US008888927B2

(12) United States Patent
Jerg et al.

(10) Patent No.: US 8,888,927 B2
(45) Date of Patent: Nov. 18, 2014

(54) RINSING METHOD FOR A WATER-BEARING DOMESTIC APPLIANCE, ESPECIALLY DISHWASHER

(75) Inventors: Helmut Jerg, Giengen (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 857 days.

(21) Appl. No.: 13/003,770

(22) PCT Filed: Jul. 22, 2009

(86) PCT No.: PCT/EP2009/059420

§ 371 (c)(1),
(2), (4) Date: Jan. 12, 2011

(87) PCT Pub. No.: WO2010/010115

PCT Pub. Date: Jan. 28, 2010

(65) Prior Publication Data

US 2011/0114126 A1 May 19, 2011

(30) Foreign Application Priority Data

Jul. 23, 2008 (DE) ..... 10 2008 040 651
Jul. 23, 2008 (DE) ..... 20 2008 017 432 U

(51) Int. Cl.

| | |
|---|---|
| ***B08B 7/04*** | (2006.01) |
| ***B08B 3/00*** | (2006.01) |
| ***B08B 9/20*** | (2006.01) |
| ***D06F 39/00*** | (2006.01) |
| ***A47L 15/00*** | (2006.01) |
| ***A47L 15/48*** | (2006.01) |

(52) U.S. Cl.

CPC ..... *D06F 39/004* (2013.01); *A47L 15/0007* (2013.01); *A47L 15/0015* (2013.01); *A47L 15/0057* (2013.01); *A47L 15/481* (2013.01); *A47L 2401/10* (2013.01); *A47L 2401/34* (2013.01); *A47L 2501/34* (2013.01); *A47L 2601/02* (2013.01)

USPC ..... 134/30; 134/25.2; 134/34; 134/35

(58) Field of Classification Search

USPC ..... 134/10, 1, 25.2, 26, 3, 34, 35, 30

See application file for complete search history.

(56) References Cited

U.S. PATENT DOCUMENTS 6,432,216 B1 8/2002 Thies
2002/0066873 A1 6/2002 Poisel et al.

(Continued)

FOREIGN PATENT DOCUMENTS

DE 4243868 A1 7/1994
DE 4415823 A1 11/1995

(Continued)

OTHER PUBLICATIONS

Granting Decision RU 2011103712 dated May 30, 2013.

(Continued)

*Primary Examiner* — Saeed T Chaudhry

(74) *Attorney, Agent, or Firm* — James E. Howard; Andre Pallapies

(57) ABSTRACT

A rinsing method for a water-conducting domestic appliance is provided in which rinsing liquid is heated to a first temperature in a first operating mode in at least one partial program step of a first rinse cycle; a scale formation in the water-conducting domestic appliance is recorded by a scale sensor arranged in a hydraulic system; the scale formation is compared with a nominal value for the scale formation; and, upon exceeding the nominal value, a second rinse cycle is executed in a second operating mode, while the rinsing liquid is heated to a second temperature that is higher than the first temperature.

12 Claims, 2 Drawing Sheets

(56) References Cited

U.S. PATENT DOCUMENTS

| | | | | |
|---|---|---|---|---|
| 2005/0150527 | A1* | 7/2005 | McKee et al. | 134/57 D |
| 2007/0295370 | A1 | 12/2007 | Jerg et al. | |
| 2008/0083433 | A1 | 4/2008 | Jerg et al. | |
| 2008/0127997 | A1* | 6/2008 | Jerg et al. | 134/10 |

FOREIGN PATENT DOCUMENTS

| | | | |
|---|---|---|---|
| DE | 19651347 | A1 | 6/1998 |
| DE | 10057210 | A1 | 5/2002 |
| DE | 102004030013 | A1 | 1/2006 |
| DE | 102005004089 | A1 | 6/2006 |
| DE | 102005061808 | A1 | 6/2007 |
| EP | 1116471 | A2 | 11/2000 |
| EP | 1658803 | A1 | 5/2006 |
| JP | 07000338 | | 1/1995 |
| JP | 08019505 | | 1/1996 |
| JP | 3297252 | B2 | 7/2002 |
| TR | WO2008077970 | A1 | 7/2008 |

OTHER PUBLICATIONS

Report of Examination and National Search Report CN 200980128795.1, Sep. 6, 2012.

* cited by examiner

RINSING METHOD FOR A WATER-BEARING DOMESTIC APPLIANCE, ESPECIALLY DISHWASHER

BACKGROUND OF THE INVENTION

The invention relates to a rinsing method for a water-conducting domestic appliance, in particular a dishwasher. Such a rinsing method is for example known from DE 44 15 823 A1.

A rinsing method for a dishwasher is known from DE 10 2005 004 089 A1, in which in a washing step a quantity of rinsing liquid provided in a washing compartment is heated to a washing temperature during a heating-up phase. A sorption column with material that can be reversibly dehydrated is provided as the drying unit, which in a drying step extracts a quantity of water from the air to be dried, and stores this. In a subsequent rinse cycle a regeneration process or a desorption then takes place during the washing step, in which, by means of an air heater, a stream of air sucked out of the washing compartment and flowing through the drying agent, is heated. With the heated stream of air the quantity of water stored in the drying agent is released as hot steam and returned to the washing compartment.

In the case of this method, however, scale formation may arise, in particular in the hydraulic system of the water-conducting domestic appliance.

BRIEF SUMMARY OF THE INVENTION

The object of the invention consists in providing a rinsing method for a water-conducting domestic appliance, in particular for a dishwasher for the suppression of undesired scale formation.

The invention is based on a rinsing method for a water-conducting domestic appliance, in particular for a dishwasher, in particular having a drying unit which has a drying agent which can be reversibly dehydrated, in which in at least one partial program step of a first rinse cycle, rinsing liquid is heated to a first temperature in a first operating mode. A rinse cycle can here encompass a multiplicity of partial program steps, such as for example pre-rinsing, washing, intermediate rinsing, rinsing and drying, which are executed in succession for the cleaning of items to be washed.

The following steps are provided to achieve the task:

- recording of a scale formation in the water-conducting domestic appliance by means of a scale sensor arranged in the hydraulic system,
- comparison with a nominal value for the scale formation, and
- upon the exceeding of the nominal value, execution of a rinse cycle in a second operating mode (II), while the rinsing liquid is heated to a second temperature ($T_{R2}$), increased in comparison to the first temperature ($T_{R1}$).

By means of the temperature increased in the second operating mode, the scale deposit becoming lodged in the feed line system of the hydraulic circuit can bed dissolved more quickly, whereby no hindrance to the flow of the rinsing liquid in the hydraulic circuit due to scale build-up need be feared. According to the invention grease deposits and/or soiling deposited in the hydraulic system are here recorded and compared with a nominal value. The first or second operating mode is then selected on the basis of the comparison.

The second operating mode with the correspondingly increased temperature can be performed after a predefined number of wash cycles in the first operating mode. In the normal case the dishwasher can thus perform wash cycles which operate in a low temperature profile, with reduced process temperatures. After the recorded grease deposits and/or deposited soiling exceed the nominal value, the control unit of the dishwasher can interpose a rinse cycle which operates in the second operating mode, that is with a high temperature profile with higher process temperatures.

To monitor the build-up of grease or soiling a scale sensor can be provided, which monitors a scale formation in the feed line system of the dishwasher and compares the actual scale deposit recorded with a nominal value. The first or second operating mode can be selected on the basis of this comparison. According to the invention the energy consumption of the dishwasher can thus be reduced as a mathematical average, that is to say over a multiplicity of wash cycles.

In the second operating mode the temperature is in particular increased such that grease deposits and/or soiling in the hydraulic system of the dishwasher can be reliably dissolved. In particular, the second temperature in the second operating mode should be in the order of 60 to 65° C.

The invention can in particular be employed in dishwashers with a separate drying system, in which during the drying step the air to be dried is sucked out of the washing compartment and drawn through a drying agent, which extracts the humidity from the air, where the thus dried air is returned to the washing compartment once again in a closed circuit.

In such a drying process, heating of the rinsing liquid in the partial program step "rinsing" preceding the drying step up to a temperature in the order of 65° C. is dispensed with. Such a heating-up process is necessary in order to enable effective condensation on the side walls of the washing compartment in a subsequent drying step. In contrast to this, according to the invention the humidity-laden air heats up to only around 30° C. during the external drying process as a result of the intrinsic heat of the items being washed. Heating to temperatures of 65 to 75° C. during the rinsing step is not necessary here.

BRIEF DESCRIPTION OF THE DRAWINGS

An exemplary embodiment of the invention is described below on the basis of the attached figures.

Where.

DETAILED DESCRIPTION OF EXEMPLARY EMBODIMENTS OF THE PRESENT INVENTION

Figure 1:
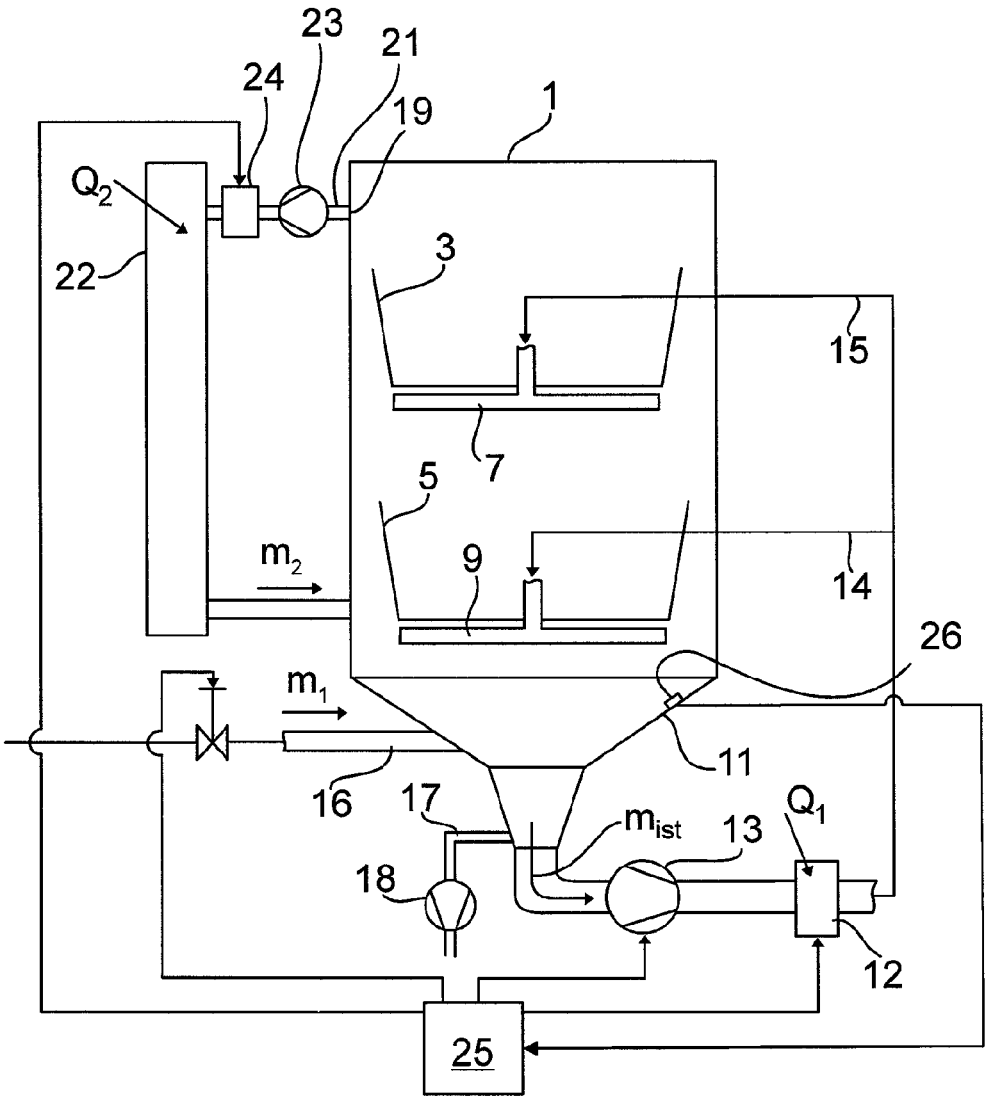
FIG. 1 shows, in a schematic block diagram, a dishwasher for execution of the rinsing method.

FIG. 1 shows, in outline schematic form, a dishwasher with a washing compartment 1, in which items to be washed (not shown) can be arranged in crockery baskets 3, 5. In the washing compartment 1, for example, two spray arms 7, 9 are provided at different spray levels as spray devices, via which the items to be washed have rinsing liquid applied to them. A pump body 11 with a circulation pump 13 is provided in the base of the washing compartment, which is fluidically connected to the spray arms 7, 9 via feed lines 14, 15. Downstream of the circulation pump 13 is a heating element 12, possibly a continuous flow heater, which is also designated as a water heater. The pump body 11 is additionally linked via connecting stubs to a fresh water feed line 16 linked with the mains water supply network and with a drain line 17, in which is arranged a drain pump 18 for pumping the rinsing liquid out of the washing compartment 1.

In its upper region the washing compartment 1 has an outlet opening 19, which is connected with a drying unit embodied as a sorption column 22 via a feed line 21. In the feed line 21 to the sorption column 22 are inserted a fan 23 and a heating element 24. As the drying agent, the sorption column 22 contains a material which can be reversibly dehydrated, such as zeolite, with which air is dried in a drying step T. To this end, a stream of air heavily laden with humidity is directed by means of the fan 23 from the washing space delimited by the washing compartment through the sorption column 22. The zeolite provided in the sorption column 22 extracts the humidity from the air and the thus dried air is once again conveyed back into the washing space of the washing compartment 1.

The quantity of water $m_2$ stored in the zeolite in the drying step T can be released once more in a regeneration process, that is to say a desorption, through heating of the drying agent of the sorption column 22. To this end a stream of air heated to high temperatures by means of the heating element 24 is guided through the sorption column 22 by the fan 23, and with this the water stored in the zeolite is released as hot steam and is thus directed back into the washing compartment 1. The above-described regeneration process in the sorption column 22 takes place in the temperature time profile shown in FIG. 2 in time interval $\Delta t_R$.

Figure 2:
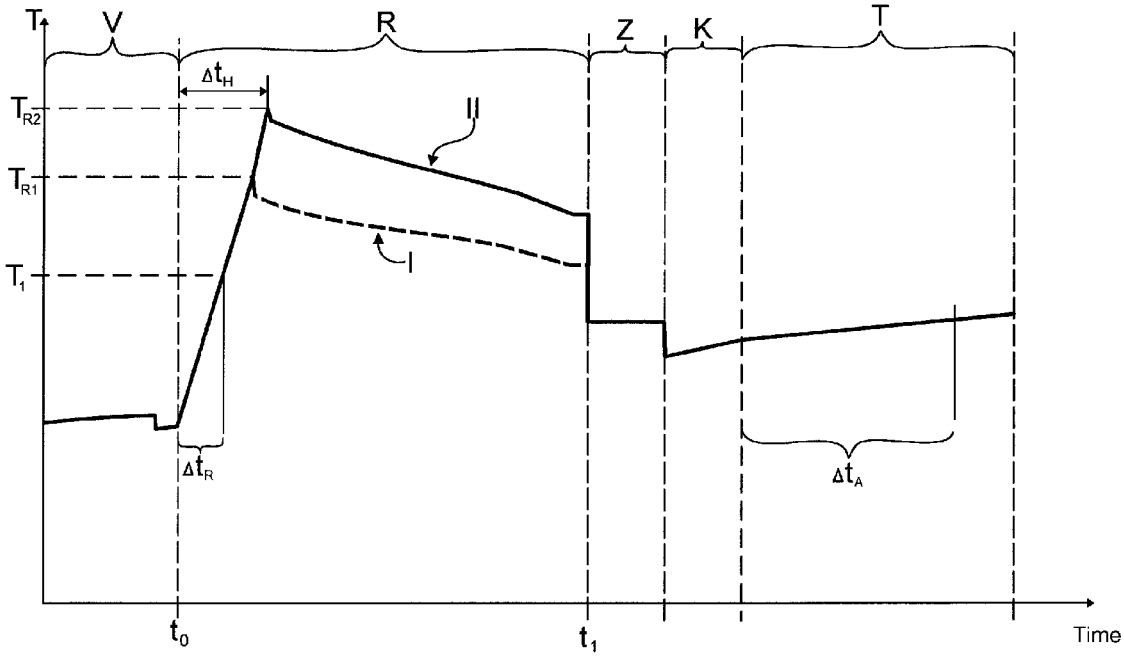
FIG. 2 shows a temperature time diagram illustrating a wash program sequence in a first washing operating mode and in a second washing operating mode.

FIG. 2 illustrates a temporal program sequence with the individual partial program steps of a rinse cycle, namely pre-rinsing V, washing R, intermediate rinsing Z, rinsing K and drying T. The partial program steps indicated in FIG. 2 are performed by means of a control unit 25 through corresponding actuation of the water heater 12, the circulation pump 13, the drain pump 18, the fan 23, the drying unit 22 and other control components.

The diagram in FIG. 2 shows both the temporal temperature profile of a first operating mode I and of a second operating mode II. The temperature profiles of the two operating modes are identical, with the exception of the different temperature courses in the washing step R. In FIG. 2, the temperature course in the first operating mode I during the washing step R is represented as a dashed line.

The heat $Q_2$ released in the regeneration process $\Delta t_R$ is used in an energy-saving manner to heat the rinsing liquid $m_{ist}$ during the heating-up phase $\Delta t_H$ of the washing step R. According to FIG. 2. the regeneration process $\Delta t_R$ thus starts after the already completed pre-rinsing step V at the start of the washing step R, at point in time $t_o$. In the regeneration process $\Delta t_R$, the quantity of water $m_2$ stored in the drying agent is conveyed back into the washing compartment 1 as steam. This quantity of water $m_2$ was extracted from the humidity-laden stream of air to be dried in the drying step T of a preceding rinse cycle during an adsorption process $\Delta t_A$. The total quantity of rinsing liquid $m_{ist}$ made available in washing step R thus arises from a quantity of fresh water $m_1$ fed into the washing compartment via the fresh water feed line 16 and the quantity of water $m_2$ returned to the washing compartment in the regeneration process $\Delta t_R$.

It is known that at the start of the washing step R the rinsing liquid which is circulated in the liquid circuit of the dishwasher by means of the circulation pump 13 is heated to a washing temperature in a heating-up phase $\Delta t_H$. The regeneration process $\Delta t_R$, running chronologically parallel with the heating-up phase $\Delta t_H$ supports the heating of the rinsing liquid. Thus during the heating-up phase not only is a first heating output $Q_1$ introduced into the washing compartment 1 by means of the first heating element 23 indicated in FIG. 1, that is the water heater, but additionally in the regeneration process a second heating output $Q_2$ is also introduced in the washing compartment 1 by means of the second heating element 24, that is the air heater. The heating output $Q_1$ of the water heater 23 can be around 2200 W, while the heating output $Q_2$ of the air heater 24 is only in the order of 1400 W.

In the heating-up phase $\Delta t_H$, the heating of the rinsing liquid can initially take place only by means of the steam released in the regeneration mode $\Delta t_R$, which can heat rinsing liquid with heating output $Q_2$ to a temperature $T_1$ of for example in this case around 40° C. Only after conclusion of the regeneration process is the water heater 12 functioning with the significantly greater heating output $Q_1$. By means of the water heater 12 which is actuated only after conclusion of the regeneration process $\Delta t_R$, thermal damage to the drying agent in the sorption column 22 can be prevented.

By means of the water heater 12 which is actuated only after the regeneration process $\Delta t_R$, the temperature of the rinsing liquid in the first operating mode I is increased from the temperature $T_1$ of 40° C. to a washing temperature $T_{R1}$ sufficiently high for cleaning purposes. The washing temperature $T_{R1}$ can here, for example be 51° C.

After the heating-up phase $\Delta t_H$, the temperature of the rinsing liquid and of the items to be washed falls broadly in a linear fashion, until at the end of the washing step R at point in time $t_1$, the rinsing liquid is directed into the wastewater system. The partial program steps "intermediate rinsing Z" and "rinsing K" following the washing step R function at rinsing liquid temperatures that are reduced still further.

The rinsing K is followed by the drying step T. In contrast to a conventional drying process, in which the drying of the humidity-laden air takes place by means of condensation on the washing compartment side-walls, it is here possible to dispense with a second heating-up of the rinsing liquid to temperatures between 60 and 70° C. in the preceding rinsing step K. Rather the drying step T takes place according to the diagram in FIG. 2 at a temperature of around 30° C., which sets in as a result of the intrinsic heat of the items to be washed.

The temperature course in the first operating mode I does however have the inherent disadvantage that during the rinse cycle no rinsing liquid at a sufficiently high temperature circulates in the hydraulic system to prevent scale formation stemming from grease deposits or other soiling. Although the washing temperature $T_{R1}$ in the first operating mode I, in the order of 50° C., is sufficient for good cleaning results, it is however not suitable for breaking down grease and flushing it from the hydraulic system.

According to the invention the control unit 25 can thus switch from the first operating mode I to the second operating mode II, in which the washing temperature is increased according to FIG. 2 to $T_{R2}$. In the second operating mode II the washing temperature $T_{R2}$ stands at around 60 to 65° C., by means of which the build-up of scale can be reliably prevented.

According to FIG. 1, to switch the control unit 25 between the two operating modes I and II, a scale sensor 26 is provided in the soiling-susceptible area of the pump body 11, which is connected via signals with the control unit 25. The scale sensor 26 and the control unit 25 can be integrated into a control loop, in which the second operating mode (II) is selected only upon a predefined degree of soiling being reached. Accordingly, as a mathematical average, that is to say over the course of a series of completed wash cycles, the energy consumption of the dishwasher can be reduced.

LIST OF REFERENCE CHARACTERS

1 Washing compartment
3 Crockery basket

5 Crockery basket
7 Spray arm
9 Spray arm
11 Pump body
12 Heating element
13 Circulation pump
14 Feed line
15 Feed line
16 Fresh water-feed line
17 Drain line
18 Drain pump
19 Outlet opening
21 Feed line
22 Drying unit
23 Fan
24 Heating element
25 Control unit
26 Scale sensor
29 Temperature sensor
V Pre-rinsing
R Washing
Z Intermediate rinsing
K Rinsing
T Drying
$T_{R1}$ Washing temperature
$T_{R2}$ Washing temperature
$\Delta t_R$ Regeneration process
$\Delta t_H$ Heating-up phase
$T_0$ Start time of washing step R
$T_1$ End time of washing step R
$m_1$ Quantity of fresh water fed in
$m_2$ Quantity of water, directed back in the regeneration process
$m_{ist}$ Quantity of rinsing liquid
$Q_1$, Heating output
$Q_2$, Heating outputs
$\Delta t_A$ Adsorption process
I First operating mode
II Second operating mode

The invention claimed is:

1. A rinsing method for a water-conducting domestic appliance, the method comprising:

heating rinsing liquid to a first temperature in a first operating mode of at least one partial program step of a first rinse cycle;

recording a scale formation in the water-conducting domestic appliance by a scale sensor arranged in a hydraulic system;

comparing the scale formation with a nominal value for the scale formation; and upon exceeding the nominal value, executing a second rinse cycle in a second operating mode, during which the rinsing liquid is heated to a second temperature that is higher than the first temperature.

2. The rinsing method of claim 1, wherein the water-conducting domestic appliance is a dishwasher having a drying unit with a reversibly dehydrated drying agent.

3. The rinsing method of claim 1, wherein the scale formation includes at least one of grease deposits and/or deposited soiling.

4. The rinsing method of claim 3, wherein the second temperature of the partial program step that is performed in the second operating mode is increased such that the one of grease deposits and deposited soiling in the hydraulic system are dissolved, and wherein the second temperature is increased to a range of 60° C. to 65° C.

5. The rinsing method of claim 1, wherein the at least one partial program step, which is operated in one of the first and second operating modes, is a washing step, in which the first and second temperatures correspond respectively to the washing temperature.

6. The rinsing method of claim 5, wherein the first and second temperatures of the at least one partial program step, which takes place before or after the washing step, are lower than a respective first or second washing temperature.

7. The rinsing method of claim 6, wherein the at least one partial program step includes one of a pre-rinsing step, an intermediate rinsing step, a rinsing step and a drying step.

8. The rinsing method of claim 7, wherein, in the drying step, air present in a washing compartment is directed through a drying unit having a reversibly dehydrated drying agent.

9. The rinsing method of claim 8, wherein the air is directed from the drying unit back into the washing compartment.

10. The rinsing method of claim 8, wherein, in a regeneration process, a quantity of water stored in the reversibly dehydrated drying agent is directed into the washing compartment as heated steam, which heats the rinsing liquid to a predetermined temperature in the washing step.

11. The rinsing method of claim 1, wherein the rinsing liquid is heated to the predetermined temperature by a water heater provided in a rinsing liquid circuit, and wherein the rinsing liquid is further heated to the one of first and second temperatures.

12. The rinsing method of claim 1, wherein the first temperature in the first operating mode is in the order of 45° C. to 55° C., and wherein the second temperature in the second operating mode is in the region of 60° C. to 65° C.

* * * * *